US011187461B2

(12) United States Patent
Harasym

(10) Patent No.: US 11,187,461 B2
(45) **Date of Patent: *Nov. 30, 2021**

(54) TIP PROTRUSIONS ON LANCE IGNITION TUBE

(71) Applicant: Michael F. Harasym, Phoenixville, PA (US)

(72) Inventor: Michael F. Harasym, Phoenixville, PA (US)

( * ) Notice: Subject to any disclaimer, the term of this patent is extended or adjusted under 35 U.S.C. 154(b) by 49 days.

This patent is subject to a terminal disclaimer.

(21) Appl. No.: 16/815,525

(22) Filed: Mar. 11, 2020

(65) Prior Publication Data

US 2020/0318906 A1 Oct. 8, 2020

Related U.S. Application Data

(60) Provisional application No. 62/830,057, filed on Apr. 5, 2019.

(51) Int. Cl.

| | |
|---|---|
| ***F27D 3/15*** | (2006.01) |
| ***C21C 5/46*** | (2006.01) |
| ***F23D 14/60*** | (2006.01) |

(52) U.S. Cl.

CPC ..... *F27D 3/1527* (2013.01); *C21C 5/4606* (2013.01); *F23D 14/60* (2013.01)

(58) Field of Classification Search

CPC ..... F27D 3/1527; C21C 5/4606; F23D 14/60

See application file for complete search history.

(56) References Cited

U.S. PATENT DOCUMENTS

| | | | | |
|---|---|---|---|---|
| 4,450,986 | A | 5/1984 | Harasym et al. | |
| 4,746,037 | A | 5/1988 | Harasym | |
| 4,787,142 | A | 11/1988 | Henderson et al. | |
| 4,877,161 | A | 10/1989 | Harasym | |
| 5,544,695 | A | 8/1996 | Harasym | |
| 5,622,672 | A * | 4/1997 | Swick | E21B 7/146 266/48 |
| 7,537,723 | B2 | 5/2009 | Harasym | |
| 7,563,407 | B2 | 7/2009 | Harasym | |
| 2020/0318208 | A1* | 10/2020 | Harasym | C21C 5/462 |
| 2020/0318906 | A1* | 10/2020 | Harasym | F23D 14/60 |
| 2020/0318907 | A1* | 10/2020 | Harasym | C21C 5/4653 |

* cited by examiner

*Primary Examiner* — Scott R Kastler

(74) *Attorney, Agent, or Firm* — Faegre Drinker Biddle & Reath LLP

(57) ABSTRACT

A thermal lance for unplugging a vessel discharge port. The thermal lance including an elongated cylindrical hollow tube made from a combustible material, the tube having an axial length with first and second ends. The tube having a cylindrical sidewall defined by an outer wall having an outer diameter and an inner wall having an inner diameter, with a wall thickness between the outer and inner walls. The tube having a longitudinal axis. At least one projection is formed integrally on the first end and has a length extending away from the first end in substantially the same direction as the longitudinal axis. A telescoping thermal lance assembly is also disclosing that includes a housing and an extension tube within which the lance is located.

16 Claims, 3 Drawing Sheets

TIP PROTRUSIONS ON LANCE IGNITION TUBE

RELATED APPLICATION

The present application is related to and claims priority from U.S. Provisional Application No. 62/830,057 filed Apr. 5, 2019, the disclosure of which is incorporated herein by reference in its entirety.

FIELD OF THE INVENTION

This invention is related to the general field of discharge ports on ladles, furnaces and tundishes, and more specifically to a thermal lance for unplugging a clogged molten metal vessel discharge port.

BACKGROUND

Discharge ports in molten metal dispensing systems at times can fail to open specifically upon an initial opening attempt, either through the clogging of the nozzle or tap hole fill material or hardened metal in the dispensing port, thereby inhibiting the flow of motel metal out of the vessel. The inventor of the instant application has developed several solutions over the years to assist in unclogging the plugged discharge port, including the inventions disclosed in U.S. Pat. Nos. 4,450,986; 4,746,037; 4,787,142; 4,877,161; 5,544,695; 7,537,723 and 7,563,407, the disclosures of which are incorporated herein by reference in their entirety.

In U.S. Pat. No. 4,450,986, a telescoping lance assembly includes a cylindrical housing that encloses a free-floating hollow metal tube. High pressure oxygen (on the order of 100 psi) is ported through the housing to propel the tube upwardly into the obstruction and to sustain burning as the combustible material is ignited. The tube is partially filled with magnesium wires or low carbon steel wires as the primary combustible material.

In U.S. Pat. No. 4,746,037, the telescoping lance assembly includes a flared bottom and a combustible collar at the top. The flared bottom is wider than the opening in a bushing located at the top of the housing to keep the tube from falling out of the housing. The tube is filled with magnesium wires or low carbon steel wires intertwined with steel wool to allow oxygen flow and to provide high surface area for combustion. The combustible collar includes a cardboard sheath wrapped around a low temperature blasting fuse and the exposed ends of the wires and steel wool. This construction provides a reliable ignition.

U.S. Pat. No. 4,877,161 discloses an improved lance assembly with a double telescoping mode to provide greater extension into a deep discharge port without the need for elongating the housing. The lance assembly includes a cylindrical housing with a port to admit pressurized oxygen. Inside the housing is either one or two free floating tubes. The tube (when single) or the uppermost tube (when dual) contains combustible magnesium or low carbon steel wires as the combustible material. The tube is crimped into the wires at the top and bottom of the tube to prevent the wires from moving forward or backward inside the tube. The tips of the wire extend out of the top end of the tube and they may be capped with an igniter covered by tape.

In another prior art lance assembly, the telescoping tube is made of stainless steel to provide a lower rate of consumption than the more combustible material of the thermal lance inside of it. The tube may have a flared base or a base flange to keep it centered in the housing, and the housing may include a bushing near the top end to prevent the tube from completely exiting the housing. The combustible material of the lance is a combination of thin cylindrical rod made of low carbon sheet metal that is roll-formed into a cylindrical rod that allows oxygen to flow axially through the rod. Rods of this type, and the process of making them, are described in U.S. Pat. No. 4,787,142. They are used as electrodes in exothermal cutting of metal and are commonly called burning bars or slice rods. They can be obtained from welding supply distributors under the brand name ARCAIR. The axial oxygen flow and increased surface area as compared to a solid bar or a hollow tubular bar provide for a rapid ignition and for burning in the presence of high temperature and oxygen flow.

The rod is surrounded by a low carbon steel sheath to provide greater rigidity and more mass of combustible low carbon steel. The sheath has an inner bore slightly greater than the outer diameter of the rod and an outer diameter less than the inner diameter of the stainless steel tube. The rod extends about ¾ inch to 1½ inches beyond the end of the sheath and several inches out of the opposite end. One end of the sheath is welded to the rod where the longer end of the rod extends such that the rod and sheath move together as a combustible lance within the telescoping tube. The top end of the tube can be crimped and filled with a steel wool (not shown) and can include a low temperature blasting fuse. This lance design provides greater combustible mass and more rigidity than the prior lances filled with steel or magnesium wires.

U.S. Pat. No. 7,563,407 discloses an improved thermal lance tip on a lance assembly. The lance assembly includes an outer low carbon steel sheath having an inner diameter. An inner rod is disposed in a sheath having an internal bore and a thin cylindrical rod that is roll-formed from low carbon steel sheet. The rod is sized for conforming fit in the bore of the tube and has a length dimension that is longer than the length of the tube. The rod is inserted into the bore of the tube and allowed to move axially within the tube under propulsion of the pressurized oxygen to allow the rod to be burned at a rate independent of the burn rate of the sheath. One or more apertures in the tube restrict the flow of oxygen until the rod is ignited. An 0 ring located near the fuse protector of the lance housing keeps the lance from moving during routine handling and storage.

Existing thermal lances can, at times, be difficult to ignite. A need, therefore, exists for an improved thermal lance that facilitates ignition.

SUMMARY OF THE INVENTION

A thermal lance is disclosed for use in unplugging a vessel discharge port. The thermal lance includes an elongated cylindrical hollow tube made from a combustible material, the tube having an axial length with first and second ends. The tube has a cylindrical sidewall defined by an outer wall having an outer diameter and an inner wall having an inner diameter. The sidewall has a wall thickness between the outer and inner walls. The tube having a longitudinal axis. A slice rod is located within the inner wall of the tube, the slice rod being formed from low carbon steel.

At least one projection is formed integrally on the first end of the tube and has a length extending away from the first end in substantially the same direction as the longitudinal axis.

In one embodiment, the projection tapers in thickness along its length from the first end to a tip end of the projection. Preferably the projection has an outer surface and an inner surface, and wherein the taper in the thickness is created by at least one of the outer surface and the inner surface angling toward the other of the outer surface and the inner surface. Alternatively, the taper in the thickness is created by both the outer surface and the inner surface angling toward each other.

In an embodiment, the projection has lateral sides that are substantially orthogonal to the length of the projection, and wherein the lateral sides are substantially parallel to one another.

In an embodiment, the projection has lateral sides that are substantially orthogonal to the length of the projection, and wherein the lateral sides angle toward one another toward the tip end.

It is contemplated that in another embodiment, the first end may have a circumference and wherein the at least one projection is a plurality of projections spaced about the circumference, each projection having a thickness along its length from the first end to a tip end of the projection. Optionally, each projection has an outer surface and an inner surface, and wherein at least one of the outer surface and the inner surface angles toward the other of the outer surface and the inner surface so as to result in a taper of the projection toward the tip end. Alternatively, each projection has an outer surface and an inner surface, and wherein both the outer surface and the inner surface of each projection angles toward the other of the outer surface and the inner surface so as to result in a taper of the projection toward the tip end.

It is contemplated that in this embodiment, each projection has lateral sides that extend between the outer surface and inner surface of each projection, and wherein the lateral sides are substantially parallel to one another.

Alternately, it is contemplated that each projection has lateral sides that extend between the outer surface and inner surface of each projection, and wherein the lateral sides angle toward one another toward the tip end.

A telescoping thermal lance assembly is also disclosed for use in unplugging a vessel discharge port. The telescoping thermal lance assembly includes a housing with an open end that has an opening, and an oxygen inlet port located on the housing spaced apart from the open end. The oxygen inlet port is configured to connect to a supply of pressurized oxygen. A cylindrical extension tube is disposed in the housing and extends partially out through the opening of the open end of the housing. The extension tube has an open top and a closed bottom opposite the open top with a sidewall extending between the open top and the closed bottom. The extension tube includes a cylindrical interior cavity, and an aperture extending through the sidewall or the closed bottom for permitting a flow of oxygen to enter into the interior cavity. The extension tube is slidingly disposed within the housing and configured to slide at least partially out of the open end of the housing when a supply of pressurized oxygen is channeled into the inlet port. The thermal lance in any of the above embodiments is located within the extension tube. Specifically, the elongated cylindrical hollow tube is slidingly disposed within the interior cavity and configured to slide at least partially out of the open top of the extension tube when a supply of pressurized oxygen is channeled into the aperture.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of the illustrating the invention, the drawings show a form of the invention which is presently preferred. However, it should be understood that this invention is not limited to the precise arrangements and instrumentalities shown in the drawings.

DISCLOSURE OF THE INVENTION

Figure 1:
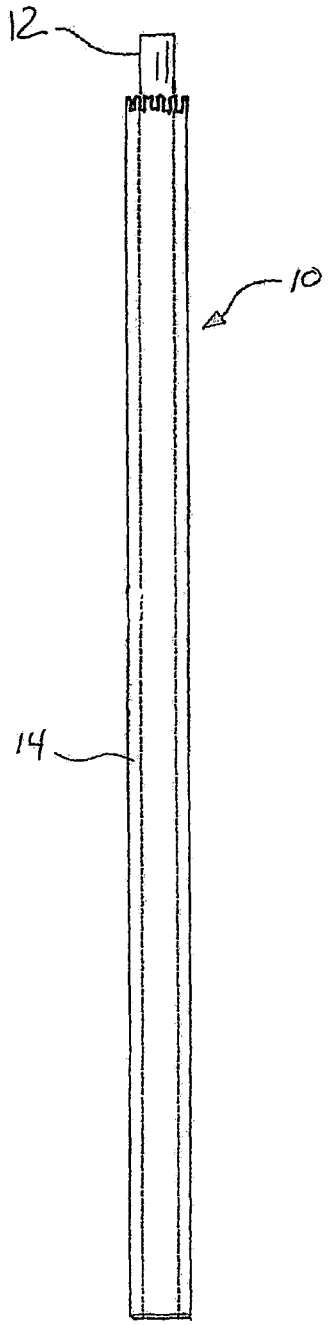
FIG. 1 is a side view of an inner lance assembly according to the present invention.
Figure 2:
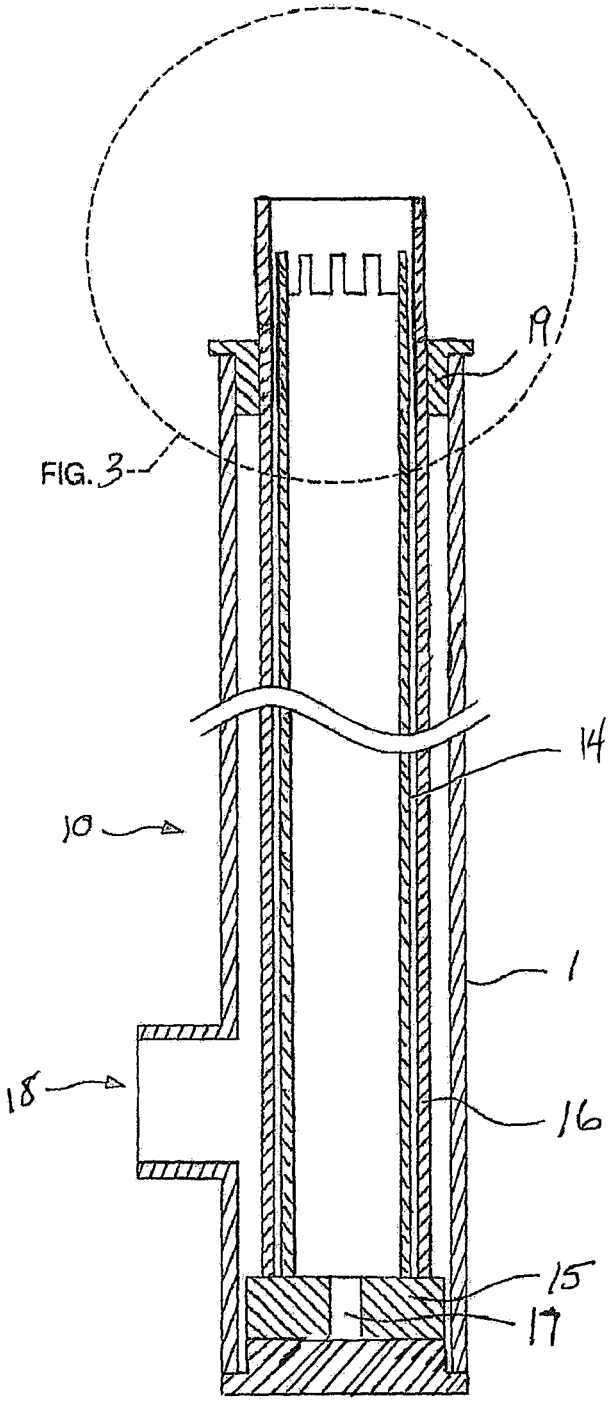
FIG. 2 is a cross sectional view of a thermal lance assembly including the inner lance assembly of FIG. 1.
Figure 3:
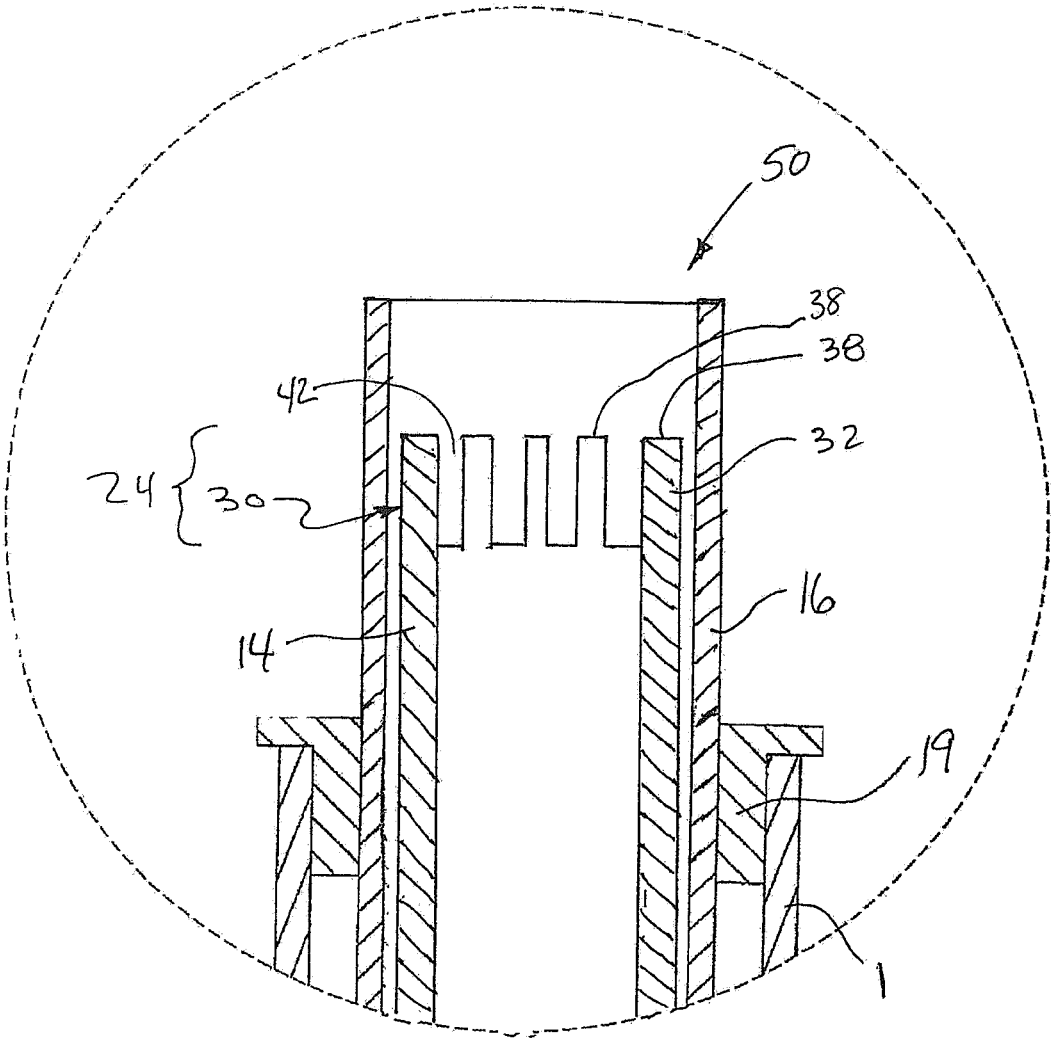
FIG. 3 is an enlarged view of the top of the thermal lance assembly of FIG. 2.

The present invention relates to an improved thermal lance for unplugging a vessel discharge port, for example, in a refractory lined ladle. As shown in FIG. 1, an inner lance assembly 10 includes a tubular thermal lance tube 14 with a lance rod 12, commonly called a burning bar or slice rod, disposed within the lance tube 14. The lance rod 12 is only shown in FIG. 1 for simplicity. The inner lance assembly 10 is located within an axially displaceable extension tube 16 which is located within the interior of a housing 1 to form a telescoping thermal lance assembly. The extension tube 16 may have a flared base or a base flange 15 (FIG. 2) to keep it centered in the housing 1, and the housing may include a bushing 19 near the top end to prevent the extension tube 16 from completely exiting the housing 1. The bottom of the extension tube 16 has an aperture 17 to allow oxygen to flow into the tube.

As noted above, the inner lance assembly 10 (lance tube 14 and lance rod 12) and tube 16 are disposed within the outer housing 1. A conduit 18 communicates pressurized oxygen to the interior of the housing 1. When the apparatus is placed in line with an obstructed discharge port and pressurized oxygen is supplied into the conduit 18 and into the housing 1 raising the axially displaceable tube 16 toward the obstruction in the discharge port. Oxygen flows around and into the interior or the raised extension tube 16 through aperture 15 to facilitate rapid burning upon ignition in the vicinity of the obstruction, as is well known in the field.

As extension tube 16 telescopes out of housing 1, lance tube 14 telescopes out of the tube 16. In addition, lance rod 12 telescopes out of lance tube 14. The telescoping extension tube 16 is preferably made of stainless steel or other high carbon steel to provide a lower rate of consumption than the more combustible material of the thermal lance rod 12 and lance tube 14 which are located inside extension tube 16. As tube 16 slides upward, the base flange 15 contacts the bushing 19 at the uppermost end of the housing 1 thereby preventing the extension tube 16 from exiting the housing 1.

As discussed above, the combustible inner lance assembly 10 includes lance tube 14 and lance rod 12, both made of low carbon steel formed into a cylindrical rod that has substantial mass and surface area, yet allows oxygen to flow axially between and through the lance tube 14 and lance rod 12. The axial oxygen flow and increased surface area provide rapid ignition and burning in the presence of high temperature molten metal and oxygen flow.

Prior to ignition, an upper portion 24 of the lance tube 14 is located within the top of the extension tube 16. The upper portion includes a tip end 30. The upper portion 24 is part of an igniter section 50. The igniter section 50 preferably includes steel wool or other flammable porous material (not shown) located inside the igniter section 50. A conically shaped cap (not shown) may be attached to the top of the extension tube 16 with a low temperature blasting fuse (not shown) extending out of the opening at the top of the extension tube 16 and through the cap.

Figure 4B:
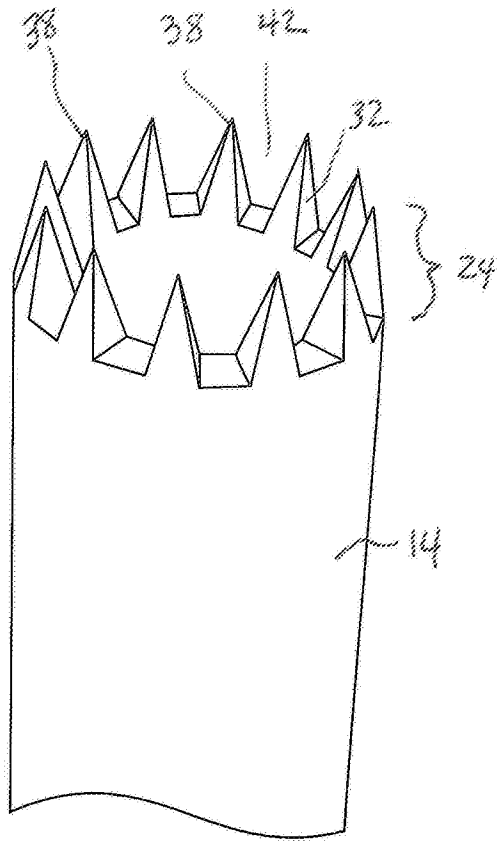
FIG. 4B is a perspective view of another embodiment of the upper portion of the lance illustrating another preferred tip configuration.
Figure 4A:
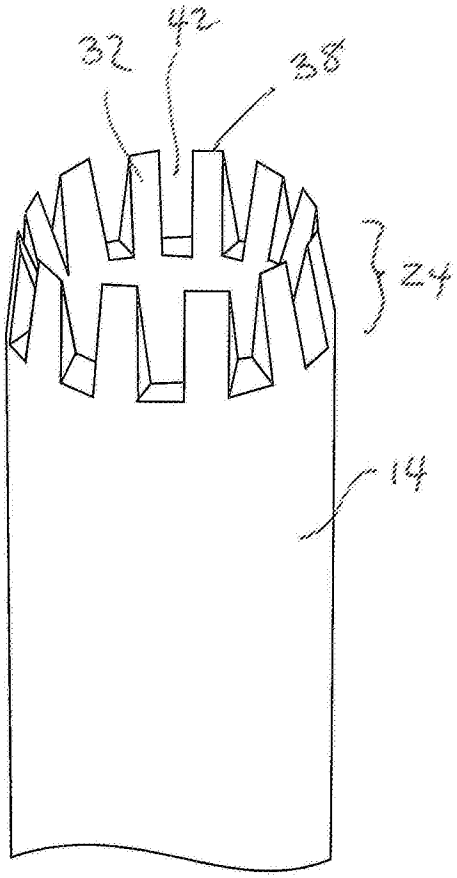
FIG. 4A is a perspective view of one embodiment of the upper portion of the lance illustrating a preferred tip configuration.

Referring to FIGS. 4A and 4B, the tip 30 includes at least one and more preferably a plurality of teeth or projections 32 that protrude upward forming a crenellation around the circumference of the tip 30. The teeth 32 may be square or may be tapered on one or both sides towards its upper edge 38 so as to minimize the thickness of the wall of the lance tube 14 and increasing the ignition points, thereby increasing the ability of the rod to ignite. The teeth are formed by a series of cuts or grooves 42 that are cut from the upper edge 38 down along the rod 30. In one embodiment, the cuts or grooves 42 extend approximately ¼ inch (more or less) in length so as to form the projections as shown. The cuts 42 are preferably evenly spaced as shown, but they need not be. In addition to creating additional surface area, the cuts 42 also provide a space for the oxygen passing though the tube 14 to pass outward through the sides of grooves 42 thereby increasing the exposure of the steel wool and the lance tube 14 to the oxygen during ignition. The present invention results in faster and more reliable ignition.

As used herein, the term "engage" is intended to both direct physical engagement through one or more components as well as operative engagement.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed. The various embodiments and elements can be interchanged or combined in any suitable manner as necessary.

The use of directions, such as forward, rearward, top and bottom, upper and lower are with reference to the embodiments shown in the drawings and, thus, should not be taken as restrictive. Reversing or flipping the embodiments in the drawings would, of course, result in consistent reversal or flipping of the terminology.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalent.

The invention claimed is:

1. A thermal lance for use in unplugging a vessel discharge port, the thermal lance comprising:

an elongated cylindrical hollow lance tube made from a combustible material, the tube having an axial length with first and second ends, the tube having a cylindrical sidewall defined by an outer wall having an outer diameter and an inner wall having an inner diameter, and the sidewall has a wall thickness between the outer and inner walls, the tube having a longitudinal axis;

a slice rod located within the inner wall, the slice rod being formed from low carbon steel; and at least one projection formed integrally on the first end of the lance tube and having a length extending away from the first end in substantially the same direction as the longitudinal axis;

wherein the first end has a circumference and wherein the at least one projection is a plurality of projections spaced about the circumference, each projection having a thickness along its length from the first end to a tip end of the projection.

2. A thermal lance for use in unplugging a vessel discharge port, the thermal lance comprising:

an elongated cylindrical hollow lance tube made from a combustible material, the tube having an axial length with first and second ends, the tube having a cylindrical sidewall defined by an outer wall having an outer diameter and an inner wall having an inner diameter, and the sidewall has a wall thickness between the outer and inner walls, the tube having a longitudinal axis;

a slice rod located within the inner wall, the slice rod being formed from low carbon steel; and at least one projection formed integrally on the first end of the lance tube and having a length extending away from the first end in substantially the same direction as the longitudinal axis;

wherein the at least one projection tapers in thickness along its length from the first end to a tip end of the projection.

3. The thermal lance of claim 2 wherein the at least one projection has an outer surface and an inner surface, and wherein the taper in the thickness is created by only one of the outer surface and the inner surface angles toward the other of the outer surface and the inner surface.

4. The thermal lance of claim 2 wherein the at least one projection has an outer surface and an inner surface, and wherein the taper in the thickness is created by both the outer surface and the inner surface angling toward each other.

5. The thermal lance of claim 4 wherein each of the at least one projection has lateral sides that are substantially orthogonal to the length of the projection, and wherein the lateral sides are substantially parallel to one another.

6. The thermal lance of claim 4 wherein each of the at least one projection has lateral sides that are substantially orthogonal to the length of the projection, and wherein the lateral sides angle toward one another toward the tip end.

7. The thermal lance of claim 1 wherein each projection has an outer surface and an inner surface, and wherein at least one of the outer surface and the inner surface angles toward the other of the outer surface and the inner surface so as to result in a taper of the projection toward the tip end.

8. The thermal lance of claim 1 wherein each projection has an outer surface and an inner surface, and wherein both the outer surface and the inner surface of each projection angles toward the other of the outer surface and the inner surface so as to result in a taper of the projection toward the tip end.

9. The thermal lance of claim 8 wherein each projection has lateral sides that extend between the outer surface and inner surface of each projection, and wherein the lateral sides are substantially parallel to one another.

10. The thermal lance of claim 8 wherein each projection has lateral sides that extend between the outer surface and inner surface of each projection, and wherein the lateral sides angle toward one another toward the tip end.

11. A telescoping thermal lance assembly for use in unplugging a vessel discharge port, the telescoping thermal lance assembly comprising:

a housing with an open end that has an opening, and an oxygen inlet port located on the housing spaced apart from the open end, the oxygen inlet port configured to connect to a supply of pressurized oxygen;

a cylindrical extension tube disposed in the housing and extending partially out through the opening of the open end of the housing, the extension tube having an open top and a closed bottom opposite the open top with a sidewall extending between the open top and the closed bottom, the extension tube including a cylindrical interior cavity, and an aperture extending through the sidewall or the closed bottom for permitting a flow of oxygen to enter into the interior cavity, the extension tube being slidingly disposed within the housing and configured to slide at least partially out of the open end of the housing when a supply of pressurized oxygen is channeled into the inlet port; and the elongated cylindrical hollow lance tube of the thermal lance of claim 1 being slidingly disposed within the interior cavity of the extension tube and configured to slide at least partially out of the open top of the extension tube when a supply of pressurized oxygen is channeled into the aperture;

wherein the extension tube includes a base flange that has a diameter that is larger than the opening in the open end of the housing so that the base flange prevents the extension tube from exiting the housing completely; and wherein the first end of the cylindrical hollow tube has a circumference and wherein the at least one projection is a plurality of projections spaced about the circumference, each projection having a thickness along its length from the first end to a tip end of the projection.

12. The telescoping thermal lance assembly of claim 11, wherein the open end of the housing includes a bearing for guiding the sliding of the extension tube, the opening in the open end being located in the bearing.

13. The telescoping thermal lance assembly of claim 11 wherein each projection has an outer surface and an inner surface, and wherein at least one of the outer surface and the inner surface angles toward the other of the outer surface and the inner surface so as to result in a taper of the projection toward the tip end.

14. The telescoping thermal lance assembly of claim 11 wherein each projection has an outer surface and an inner surface, and wherein both the outer surface and the inner surface of each projection angles toward the other of the outer surface and the inner surface so as to result in a taper of the projection toward the tip end.

15. The telescoping thermal lance assembly of claim 14 wherein each projection has lateral sides that extend between the outer surface and inner surface of each projection, and wherein the lateral sides are substantially parallel to one another.

16. The telescoping thermal lance assembly of claim 14 wherein each projection has lateral sides that extend between the outer surface and inner surface of each projection, and wherein the lateral sides angle toward one another toward the tip end.

* * * * *